United States Patent [19]

Gray

[11] Patent Number: 4,668,534

[45] Date of Patent: May 26, 1987

[54] METHOD AND APPARATUS FOR APPLYING FUSION BONDED POWDER COATINGS TO THE INTERNAL DIAMETER OF TUBULAR GOODS

[75] Inventor: Kenneth W. Gray, 2403 Bobwhite Dr., Odessa, Tex. 79762

[73] Assignees: Ben E. Meyers; Joe C. McQueen; Kenneth W. Gray, all of Odessa, Tex.

[21] Appl. No.: 821,161

[22] Filed: Jan. 21, 1986

[51] Int. Cl.[4] ..... B05D 7/22

[52] U.S. Cl. ..... 427/183; 427/181; 427/195; 427/234; 118/308; 118/318

[58] Field of Search ..... 427/181, 182, 183, 195, 427/231, 233, 234; 118/310, 308, 318; 239/402

[56] References Cited

U.S. PATENT DOCUMENTS

| | | | |
|---|---|---|---|
| 4,090,666 | 5/1978 | Peck | 118/629 X |
| 4,243,699 | 1/1981 | Gibson | 118/308 X |
| 4,382,421 | 5/1983 | Warren et al. | 118/308 X |
| 4,454,173 | 6/1984 | Koga | 427/181 X |

FOREIGN PATENT DOCUMENTS

| | | | |
|---|---|---|---|
| 295268 | 3/1966 | Australia | 427/182 |

*Primary Examiner*—Shrive P. Beck
*Attorney, Agent, or Firm*—Wendell Coffee; Montgomery W. Smith

[57] ABSTRACT

Air is flowed within an annulus fluidly connected to the load end of a pipe to be coated. A premeasured charge of powdered coating material is suspended in an injection airflow and then injected into the annulus. Spiral flow of the air and particles of coating material in the annulus is induced by successively jetting air into the annulus at selected angles to axial flow. The resulting powder cloud has spiral annular movement within the annulus toward the load end of the pipe. An optional conical deflector at the load end deflects the spiral cloud toward the wall of the pipe. The pipe is rotated counter to the tangential or circumferential component of the spiral flow. The nonaxial circumferential component of the spiral flow helps reduce the number of holidays, and insures that the coating material is deposited evenly through the length of the pipe for a uniform coating thickness. The powder cloud is much longer than the pipe. The excess coating material exiting the pipe discharge end is recycled.

15 Claims, 12 Drawing Figures

METHOD AND APPARATUS FOR APPLYING FUSION BONDED POWDER COATINGS TO THE INTERNAL DIAMETER OF TUBULAR GOODS

BACKGROUND OF THE INVENTION (1) Field of the Invention

This invention relates to the application of a fusion bonded coating to the interior surface of tubular goods.

(2) Description of the Prior Art

Processes for coating the interior surface of tubular goods with fusion bonded thermosetting and thermoplastic coating material were known before this invention. Prior to filing this application, a search of United States Patent and Trademark Office references developed the following U.S. patent references:

DE HART, U.S. Pat. No. 3,207,618; INAMURA ET AL., U.S. Pat. No. 3,850,660; INAMURA ET AL., U.S. Pat. No. 3,974,306; KATO ET AL., U.S. Pat. No. 3,982,050; GIBSON, U.S. Pat. No. 4,089,998; GIBSON, U.S. Pat. No. 4,243,699; WARREN ET AL., U.S. Pat. No. 4,382,421; GIBSON, U.S. Pat. No. 4,420,508.

Despite the advance in the art represented by these patents, problems of uneven coating thickness over the length of the tubular goods, and the presence of "holidays" in the coating, have persisted. The term "holidays" is commonly used in the art to describe those positions in the coating along the length of tubular goods where the bare metal of the pipe wall is exposed by a "gap" or "hole" in the coating.

The frequency of holidays is also related to the thickness of the coating, such that an increase in the coating thickness tends to reduce the number of holidays. However, increasing the coating thickness uses more coating material and increases the cost of the product. A thick coating also reduces the flexibility of the coated tubular goods.

GIBSON, U.S. Pat. No. 4,089,998 applies a vacuum to a discharge end of a length of pipe, and connects the other end to a fluidized bed of coating material. The vacuum withdraws an amount of coating material into the preheated pipe. The pipe is rotated at 80–100 rpm during coating process. Immediately after the coating charge is loaded into the pipe, the vacuum is shut off and air pressure is applied at the load end of the pipe behind the charge to blow the short envelope of coating material through the pipe to the discharge end.

The changes in pressure within the pipe during this coating process also cause changes of the velocity of the coating particles. A thick coating at the load end results where the particles have a long dwell or residence time upon initial loading. Just downstream of the load end, a zone of reduced coating thickness results from the sudden increase in particle velocity. A zone of increasing coating thickness toward the discharge end of the pipe results as the velocity of the particles through the pipe is reduced due to friction and decreased pressure. If increased air pressure is used to compensate for this, the powder particles will have a greater velocity and would tend to be blown through the discharge end without sufficient residence time to melt on the pipe wall. This would produce another zone of decreased film thickness. The number of holidays tends to increase within the zone of decreased coating or film thickness.

GIBSON U.S. Pat. No. 4,089,998 also discloses an alternate structure for coating the pipe, wherein a continuous airflow is moved linearly from a horizontal tube through a pipe rotated at 80–100 rpm. A charge of the powdered coating material is collected in a chamber below the horizontal tube. Air flow upward through the chamber and a vertical tube connecting the chamber to the horizontal tube blows the charge into the horizontal air stream. After the charge is loaded, the vertical injection air stream is stopped. GIBSON discloses shutting off the horizontal air stream before the coating process is complete. The many changes in pressure and airflow and the consequent changes in particle velocity result in varying coating thicknesses throughout the length of pipe.

DE HART uses a vacuum to withdraw a measured charge of coating material from a fluidized bed into one end of a pipe. The vacuum is removed when the remaining portion of the charge is at the middle of the pipe. The process is repeated at the other end of the pipe, either from a second fluidized bed, or by turning the pipe around and repeating with another charge from the first bed. When initially withdrawn into the end of the pipe, the particles tend to be accelerated by the vacuum, resulting in a lower coating thickness at the ends of the pipe. A higher thickness, due to overlap of the coatings, results at the middle of the pipe.

KATO ET AL meter a charge of coating particles into a linear air stream flowed through a short length of small diameter conduit. Deposit of particles on the conduit walls will reduce the amount of powder in the air stream, and constant pressure on the decreasing particle density will cause the suspended particles to increase velocity. This results in a thick coating at the load end that gets thinner as the distance from the load end increases.

In the exercise of greater than ordinary skill, the workers in the art have tried the many different approaches above. They have tried variations in pressure, or the maintenance of constant pressure, with differing effects. Yet, no prior art process has satisfactorily solved the nonuniform coating thickness problems or reduced the occurrence of holidays to an economically profitable level for the coater.

SUMMARY OF THE INVENTION (1) New Function and Surprising Results

The invention concerns a new process that achieves substantially uniform coating of pipes with reduced holidays. This enables the use of thinner coatings reducing the amount of coating material used; increasing the flexibility of the coated tubular goods and providing more efficient production of interior surface coated lengths of tubular goods.

As with the prior art devices, this invention preferably uses powdered coating materials. The powder particles are suspended in and moved through the length of the tubular goods by airflow. The excess coating material not fusion bonded to the inside surface of the tubular goods is recycled.

Unlike the prior art, this invention utilizes a new method of flowing the particles of coating material through the tubular goods. The particles are air suspended and induced into spiral flow within an elongated annulus. The annular, spiral cloud of particle is spiraled at constant pressure into and through a length of tubular goods fluidly connected to the annulus. The spiralling powder cloud is rotated in a direction which is opposite that of the pre-heated, rotating pipe.

The annular spiral flow has many beneficial results. The density of the cloud is lower along the axis of the pipe, and the greatest amount of coating particles are positioned proximate the pipe wall. Further, the centrifugal force of the spiral flow tends to move and maintain the particles toward the pipe wall. The chances of holides are reduced and a uniform coating thickness is developed.

Because of friction with the pipe wall, the linear velocity of the spiraling particles will be slowed under constant pressure. This decrease in linear velocity due to friction is counteracted by a decrease in the mass of the particle cloud as particles deposit on the pipe wall, tending to accelerate the particles under the constant pressure. Thus, the linear velocity of the particles is maintained substantially constant.

As discussed above in the description of the prior art, long dwell or residence time of coating particles at the load end of the pipe ordinarily causes an increased coating thickness at the load end. This results because, unlike the annular, spiral flow of this invention, the tangential or circumferential velocity of the particles is zero in all of the prior art devices. With spiral flow, however, the tangential velocity of the particles is high at the load end, thus reducing the dwell or residence time of the particles at that point along the pipes.

As the spiral cloud moves through the pipe, the tangential velocity of the particles in the cloud will be decreased because of friction with the wall. The decreased tangential velocity relative to the constant linear velocity results in elongation of the spiral flow. Decreased tangential velocity downstream of the load end compensates for the reduction in the amount of coating particles further down the pipe by increasing the dwell or residence time proportionately. Thus, the net residence time of the particles is maintained constant over the length of the pipe, and hence, the coating thickness is uniform.

At the discharge end, the spiral in the preferred embodiment has lengthened until it is almost a linearly flowing annular cloud, with decreased particle density along the axis or center of the pipe. The length of the spiralling powder cloud, or the continuous application of the powder, is always considerably longer than the length of the tubular goods.

The results described above may be obtained for almost any length or diameter of pipe by simply adjusting the spiral flow. The total airflow rate, the diameter and size of the annulus, the air pressure, and orifice sizes may be varied as needed to obtain the necessary particle velocities and annular spiral form.

To understand how the spiral movement of the particles according to my invention reduces holidays, one must first understand why such holidays are so difficult to eliminate using the prior art methods. FIG. 1 shows an elevated pipe defect resulting in a holiday. FIG. 2 shows a holiday caused by a depressed pipe defect. As may be seen, such holidays are formed primarily because the linear direction of the powder particle travel results in a shadow, or "lee" protected side of the defect. Because the particles tend to move past the exposed leeward or downstream face of the defect, such holidays are almost impossible to prevent without excessive coating thicknesses to simply overwhelm the holiday causing defect.

However, with the spiral flow according to my invention, the direction of particle travel is not only linear or axial, but also has a circumferential or tangential component, so that the particles are traveling angularly to the protected downstream face of the defect and therefore have a significantly greater probability of impacting on the protected or lee face of the defect, and eliminating the potential holiday.

Another benefit of the spiral flow, and the enhanced ability to control and adapt the spiral movement and velocity of the powder particles it provides, is the significant reduction in coatability defects, such as runs, sags, and orange peel. Unfortunately, such coatability defects persisted with prior art coating apparatus, because of inadequate control over equipment functions and the operating principle upon which the prior equipment was based. With the apparatus and method discussed above, the spiralling powder cloud can be customized to produce almost any desired coating.

Thus, my invention produces the surprising and unexpected results of substantially reducing holidays and uniformly coating a length of tubular goods by inducing annular spiral flow of the coating particles.

It may also be seen that the total function of my invention far exceeds the sum of the functions of the individual parts such as tubes, pipes, air compressors, valves, and the like.

(2) Objects of this Invention

An object of this invention is the substantially uniform coating of the interior surface of tubular goods.

Another object of this invention is the significant reduction of holidays in such coatings.

Still another object of this invention is significant reduction of coatability defects in such coatings.

Further objects are to achieve the above with apparatus that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 4 is a side section view of the apparatus taken substantially along line AA—AA of FIG. 4.

Figure 1:
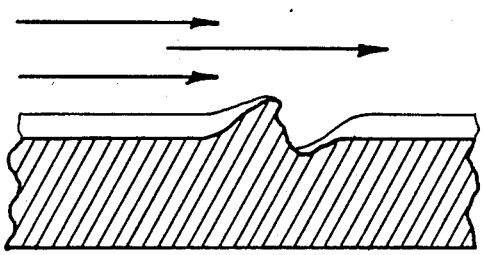
FIG-1 PRIOR ART
FIG. 1 is a section view of an elevated pipe defect according to the prior art.
Figure 2:
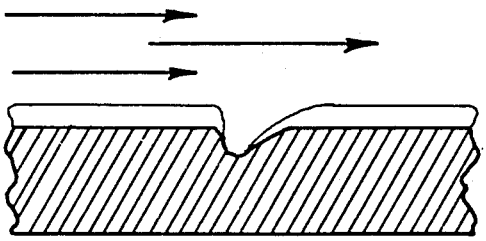
FIG-2 PRIOR ART
FIG. 2 is a sectional view of a depressed pipe defect according to the prior art.
Figure 3:
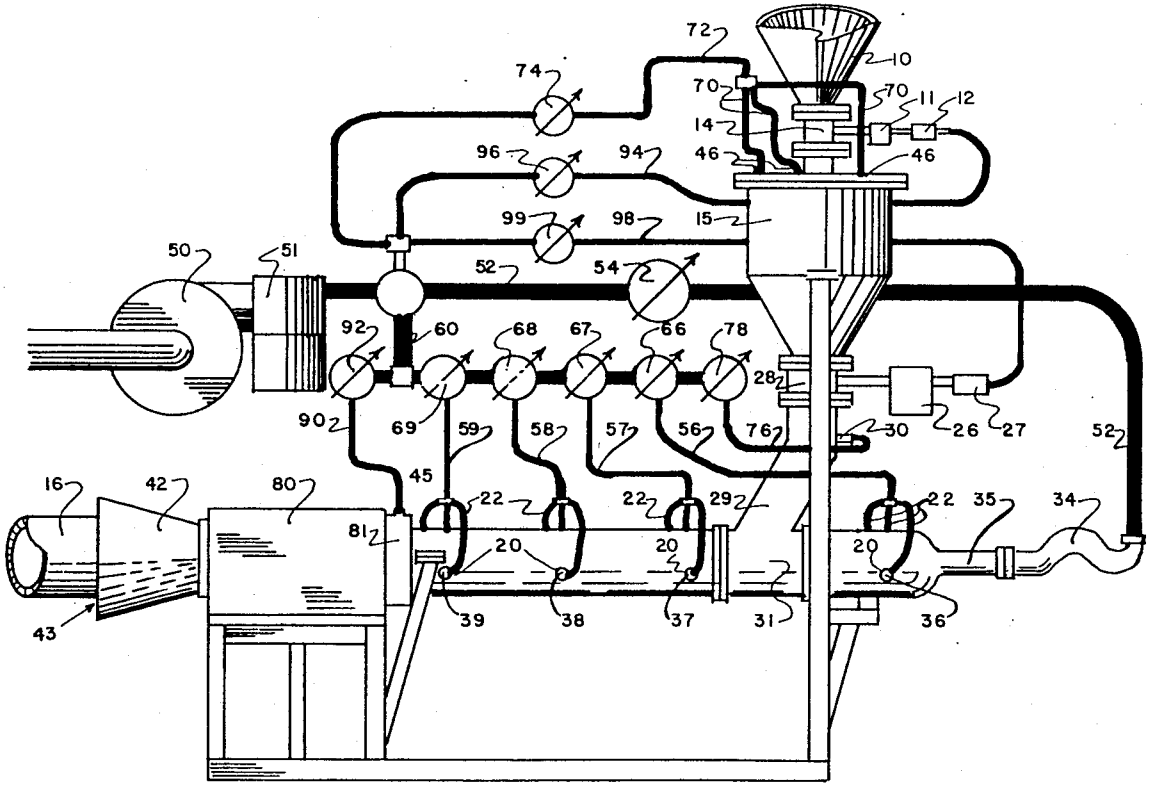
FIG. 3 is a somewhat schematic side elevation view of the apparatus for coating a length of tubular goods.
Figure 4:
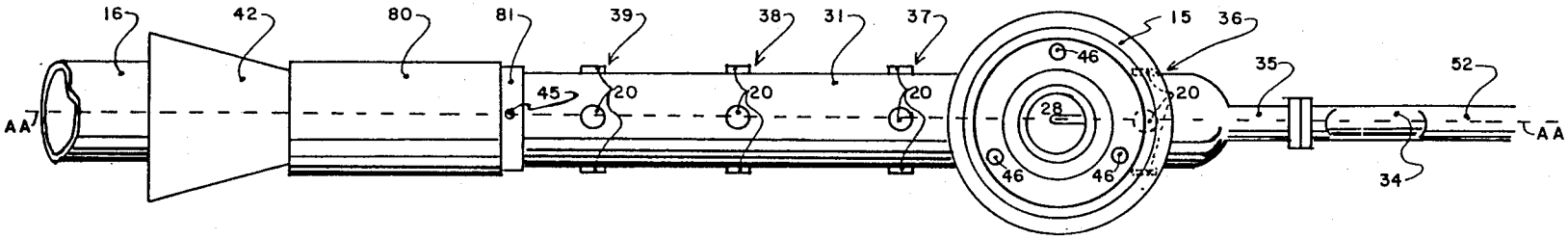
FIG. 4 is a top plan view of the apparatus shown in FIG. 3.

As an aid to correlating the terms describing this invention to the exemplary drawing, the following catalog of elements is provided:

Catalog of Elements

10 receiving hopper
11 valve drive unit
12 variable speed reducer
14 receiving gate valve
15 charge hopper
16 pipe
20 jets
22 jet lines
26 valve drive unit
27 variable speed reducer
28 charge gate valve
29 injection tube
30 venturi tube
31 coating barrel
32 deflector
33 annulus
34 trap
35 linear injection tube
36 spiral jet band
37 spiral jet band
38 spiral jet band
39 spiral jet band
41 load deflector
42 rotating connector cone
43 load end
44 discharge end
45 housing inlet
46 injection inlets
50 compressor
51 compressor filter
52 linear air line
54 linear pressure regulator
56 band line
57 band line
58 band line
59 band line
60 main line
66 band regulator
67 band regulator
68 band regulator
69 band regulator
70 injection inlet lines
72 charge injection line
74 charge injection regulator
76 venturi line
78 venturi regulator
80 connector housing
81 housing seals
82 jet bodies
84 shoulders
86 bezels
87 bolts
88 flanges
90 housing line
92 housing regulator
94 receiving valve line
96 receiving valve regulator
98 charge valve line
99 charge valve regulator
100 coating barrel
102 deflector
103 annulus
104 jets
106 jet band block
108 block bolts
110 annulus

DESCRIPTION OF THE PREFERRED EMBODIMENTS

The word "annulus" as based herein refers to the elongated space between the inside wall of a tube and the outside wall a smaller diameter cylinder coaxially disposed within the tube. Thus, such an annulus has a longitudinal axis extending along the axes of the tube and cylinder, and a length equal to the length of the shorter of the tube and cylinder.

The word "spiral" describes the shape of the air and coating particle flow created in practicing the invention. As used herein, the word "spiral" refers to a helical or coiled shape. Specifically, the spiral movement has a longitudinal or axial or linear component and a tangential or circumferential component.

The term "axial flow" or "axial component" is used to refer to flow in a direction that is parallel to a reference axis. The reference axis is preferably the axis of the annulus or the axis of the tubular goods.

The spiral flow would move tangentially at the inside surface of the pipe or outside limit of the annulus, except that the physical barrier of the pipe wall continually redirects the gas and particle flow circumferentially. Hence, the circumferential component of the spiral movement is directed tangentially of the axis at the barrel bore or pipe wall, within a plane that is normal to the axis.

The shape of the spiral movement is substantially ring like or annular. Centrifugal force will maintain the particles at or near the inside surface of the tubular goods and away from the center or axis. The density of the particle cloud will be much less along the axis of the tubular goods, and much more along the inside diameter or wall or surface.

The exemplary apparatus and method disclosed hereafter are specifically for coating 36 to 44 foot lengths of pipe having outside diameters from 6⅝ through 12¾ inches. Although examples of specific pressures, angles, and dimensions will be specified, it will be understood that this is only to enable the reader to understand the invention. Other settings of the apparatus, and other structural configurations thereof, may be successfully employed in practicing the process according to the invention.

Although air is used to suspend and flow the particles through the pipe, it will be understood that if desired or necessary, because of the particular coating material used, pure gases or gas mixtures other than air could be employed.

The coating material is preferably a thermosetting or thermoplastic compound that will fusion bond to the inner surface or wall of a pipe heated above the fusion temperature of the coating material. The material is preferably comminuted to a powder of particle size that will be supported by the gas or airflow rate anticipated within the pipe.

Coating barrel 31 is elongated, preferably in the form of a length of tubing or pipe, having a longitudinal axis and a smooth cylindrical axial bore. The bore is open at an outlet end of the barrel. An inlet end of the barrel is closed. The bore is fluidly connected at the inlet end to a source of compressed air in the form of compressor 50, by linear injection tube 35 and linear air line 52. Linear pressure regulator 54 maintains a selected linear air pressure in the linear injecton tube 35. The inner diameter of the linear injection tube 35 is preferably sized, and the linear air pressure selected, to provide a desired airflow rate into the barrel bore at the inlet end.

Elongated smooth cylinder or deflector 32 is preferably telescoped or disposed or positioned within the bore of the barrel 31 coaxial therewith, to form elongated annulus 33. Of course, the axis of the annulus 33 coincides with the longitudinal axis of the barrel. The annulus is preferably of uniform cross section with smooth cylindrical walls for the length of the deflector 32.

The deflector 32 is preferably tubular and closed at both ends. The deflector could also be solid if desired, as shown in some of the drawings for sake of clarity. The end of the deflector tube proximate the inlet end of the barrel is preferably rounded to facilitate linear or axial airflow from the linear injection tube 35 into the annulus 33.

Spiral jet bands 36, 37, 38, and 39 are axially spaced along the barrel 31 between the inlet and outlet ends. Each band preferably has three jets 20 circumferentially spaced at 120 degree intervals about the axis of the annulus 32. As will be described more fully later, each spiral jet is selectively oriented to direct a jet of air into the annulus 33 at a nonaxial direction to deflect the airflow in a desired spiral direction. The staged application of the jets of each bond 36, 37, 38, and 39 will deflect the spiral airflow at successively greater angles to the axis.

The jets 20 of each jet band 36, 37, 38 or 39 are preferably fluidly interconnected by jet lines 22 so that the gas or air pressure supplied to the jets of a particular jet band is the same. The diameters, airflow characteristics, and jet direction of the jets 20 of each jet band are also preferably identical so that at each axially spaced position of the bands, the jets 20 of the respective band will cooperatively and uniformly induce the desired deflection of airflow within the annulus 33.

The jet lines 22 of each jet band 36, 37, 38, and 39 are connected to band lines 56, 57, 58, and 59, respectively. Band pressure regulators 66, 67, 68, and 69 fluidly connect band lines 56, 57, 58, and 59, respectively, to the compressor 50 through main line 60. The band regulator 66, 67, 68, or 69 maintains a selected band air pressure to the jets of each respective band 36, 37, 38, or 39.

Each of the airflows into the annulus from gas means for flowing gas from a source of compressed gas in the form of the compressor 50, into the annulus 33, toward the open end of the bore, or the barrel outlet. The spiral jets and jet bands also form spiral means for inducing spiral movement of the gas and particles within the annulus so that the spiral movement has an axial component directed toward the open end of the bore and a circumferential component directed tangentially of the axis.

Figure 5:
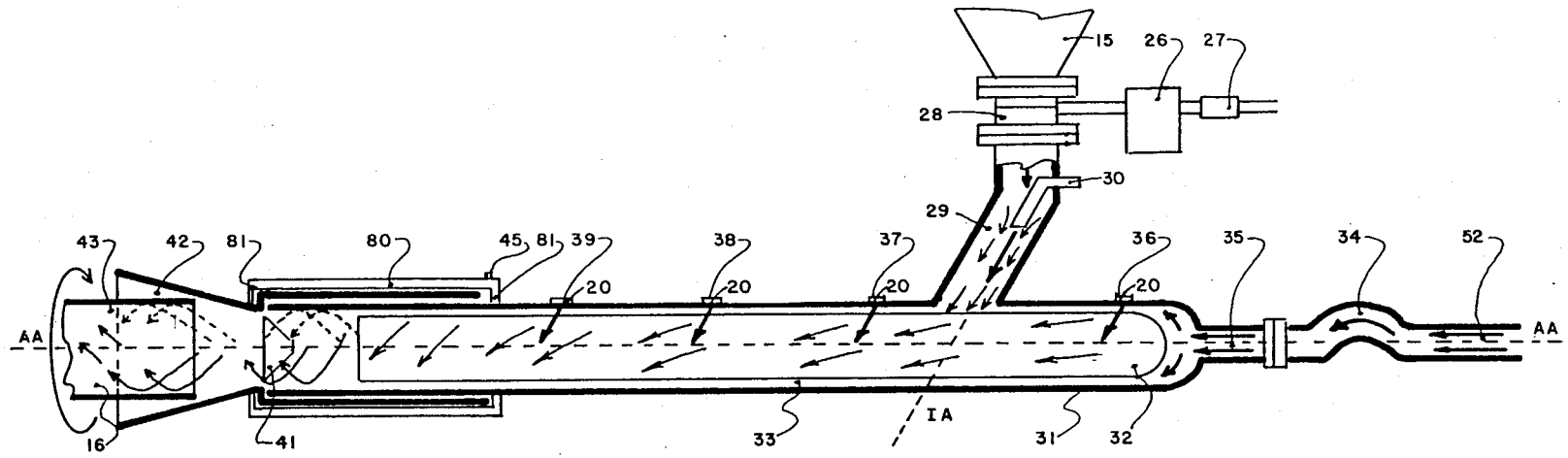

Powder or particle injection tube 29 is fluidly connected to the annulus 33 at the top of the barrel 31 between the spiral jet bands 36 and 37. The tube 29 has an injection axis IA that is preferably angled at 60 degrees to the axis of the annulus as shown in FIG. 5.

Powder charge hopper 15 is fluidly connected to the other end of the powder injection tube 29 through charge gate valve 28. The valve 28 has drive unit 26 and variable speed reducer 27 operatively connected thereto for opening the gate valve at a selected rate and allowing any powder charge collected in the hopper 15 to flow into the tube 29 and thence into the annulus 33. The hopper 15 is preferably air tight when the gate valve 14 connecting powder receiving hopper 10 to the hopper 15 is closed.

Receiving hopper 10 is positioned to collect powdered coating material from a weighing mechanism (not shown) that accurately weighs a preselected charge of powder coating substance obtained from a fluidized bed (not shown) of the powdered coating material. The receiving hopper 10 is preferably positioned above the charge hopper 15 for conveniently dumping the premeasured powder charge collected from the fluidized bed into the charge hopper 15. Receiving gate valve 14 at the bottom of the hopper 10 utilizes drive unit 11, and variable speed reducer 12 operatively connected thereto, to open the valve 14 at a desired rate and dump the powder collected in the receiving hopper 10 into the charge hopper 15.

The weighing mechanism referred to above, the hopper 10 and 15, and the associated structures, provide measuring means associated with the hopper for measuring a desired charge of coating material into the injection tube 29.

I prefer to use a computerized digital weighing system although any suitably accurate weighing mechanism could be employed to measure the desired charge into the receiving hopper 10. The coating charge will depend on the pipe diameter and length, and the type of coating substance employed. The design or procurement of such a weighing system and a fluidized bed are well within the skill of one with ordinary skill in the art. This structure is omitted from the drawing to avoid unnecessarily complicating the disclosure.

Likewise, many of the necessary gauges, solenoids, electrical components, timers, buttons, and other controls that may be advantageously employed are not disclosed herein, since those with ordinary skill in the art will be well able to provide them.

Injection air inlets 46 are spaced at 120 degree orientations about the top of the hopper 15. The injection inlets 46 are fluidly interconnected by injection inlet lines 70 to flow substantially the same gas pressure to the inlets 46. The inlet 46 is fluidly connected to the compressor 50 through the inlet lines 70 and fluidly connected charge injection line 72. Charge injection regulator 74 is in the charge injection line 72, and maintains a selected charge injection pressure at the inlets 46. The openings of the inlets 46 are sized to provide a desired airflow rate when a selected pressure is placed thereon.

Venturi tube 30 is disposed within the injection tube 29 at about a 60 degree angle to the longitudinal axis of the annulus. The venturi tube 30 is fluidly connected to the compressor so 50 through venturi line 76. Venturi regulator 78 in the venturi line 76 maintains a selected venturi pressure at the venturi 30. The venturi tube 30 is preferably sized, as with the injection inlets 46, for predictable desired airflow rates at selected venturi pressures.

The inlets 46 and venturi tube 30 provide a push-pull effect on the powder charge in the charge hopper 15 when the charge gate valve 28 is opened. The airflow and pressure from the injection air inlets 46 pushes the powder from above, while the effect of the venturi tube 30 airflow suctions the powder from below. The turbulence from the airflows within the powder injection tube 29 promotes air suspension of the powder particles and formation of a "cloud" of particles of coating material.

The powder charge measuring and handling devices and the venturi 30, hopper injection inlets 46, gate valve 28 and injection tube 29 all combine to form injection means fluidly connecting a source of coating material to the annulus for suspending particles of the coating material in the gas within the annulus.

The linear injection tube 35 preferably has trap 34 therein to prevent powder coating blow back.

As air from the linear injection tube 35 flows linearly or axially into the annulus 33, it encounters and is deflected by the airflow from the jets 20 of the jet band 36 into spiral movement or airflow of direction. As the air flows in a spiral downstream toward the outlet end of the barrel, it encounters the airflow and, when released, particles of coating material entering the annulus at the 60° angle of the injection axis IA of the injection tube 29 and venturi tube 30 airflows, and is further deflected in the spiral direction.

As the cloud of powdered coating material spirals further downstream past the bands 37, 38, and 39, it is successively deflected more and more to the desired annular spiral movement or flow. The cloud then spirals from the annulus into the space between the end of the deflector 32 and the outlet end of the barrel 31.

A length of tubular goods, or for this embodiment, a 40 foot length of pipe 16 is fluidly connected to the outlet end of the barrel at a load end 43 of the pipe 16 by rotatable connector cone 42. The connector cone 42 forms connector means at an open end of the barrel 31 bore for fluidly connecting an end of the annulus to a load end of a length of the tubular goods. The use of the connector cone 42 permits the mating, or fluid connection, of various diameters of pipe to the outlet end of the barrel 31. The connector cone 42 is journaled for free rotation within connector housing 80.

As shown in FIG. 5, the rotatable connector cone 42 is telescoped over the end of the barrel 31. To prevent the loss of powder through the space between the connector cone 42 and the outside of the barrel 31, housing inlet 45 is a fluid connection point for pressurization of the space between the connector cone 42 and the barrel 31 at substantially the pressure of the spiral flow at the barrel outlet end. The equalization of pressure confines the spiral cloud to the interior of the pipe.

All of the pressure regulators described above form pressure control means in the fluid connection of each spiral jet to the source of pressurized gas for maintaining a selected pressure of gas flowed to each spiral jet so that the selected flow rates of gas through each jet is maintained. The band pressure regulators 66, 67, 68, and 69 form similar pressure control means in the fluid connection of the spiral jets of each band to the source of pressurized gas.

The connector cone 42 is freely rotatable because the length of tubular goods or pipe 16 being coated is preferably rotated about its longitudinal axis at less than eighty revolutions per minute (80 rpm) during the coating process. The apparatus for rotating the pipe 16 is well known in the art, and is omitted to avoid unnecessarily complicating the disclosure. For the same reason, the apparatus for heating the pipe is also not shown or described, and is well known to those with ordinary skill in the art.

The tubular goods are preferably rotated counter to the circumferential component of the spiral movement of the cloud. This increases the relative tangential or circumferential velocity of the coating particles at the pipe wall, and reduces dwell or residence time of the coating particles at a given point on the pipe wall.

Deflector cone 41 is positioned proximate the outlet end of the barrel 31. The deflector cone 41 facilitates the coating of pipes having larger inside diameters than the barrel 31 by directing the particles of the spiral cloud toward the pipe inside surface as they exit the barrel 31 outlet end. The diameter of the cone 41 may be varied with the pipe diameter. It serves to increase the velocity of the powder coating cloud as it enters the load end of the pipe. At higher air velocities, less coating is deposited on the hot pipe. The powder coating cloud moves even closer to the internal diameter of the coating barrel, as it increases speed.

Figure 6:
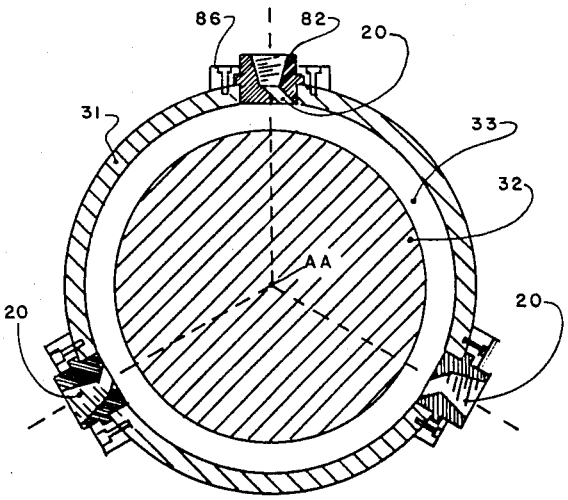
FIG. 6 is a section view of a band of jets taken normal of the annulus axis AA as shown in FIGS. 4 and 5.
Figure 7:
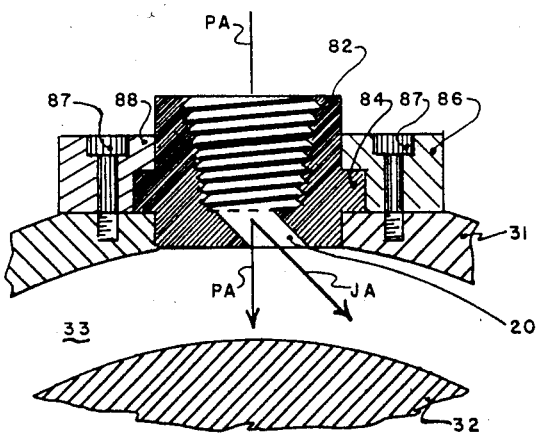
FIG. 7 shows a jet of the jet band shown in FIG. 6.

FIGS. 6 and 7 show the preferred form of the jet bands 36, 37, 38, and 39 and of the jets 20. Jet body 82 of each jet 20 has a pivot bore and a pivot axis PA, and a jet bore and a jet axis JA angled at 45 degrees to and extending from the pivot bore and the pivot axis PA, respectively. A hole in the barrel 31 at the location of the jet 20 is sized so that the jet body 82 will pivot freely about the pivot axis PA within the hole, with shoulder 84 of the jet body 82 flush against the barrel 31 outer surface. The barrel outer surface outside the periphery of the hole is preferably flattened, or made planar, to facilitate flush contact of the shoulder 84 and the barrel 31 to prevent leaking.

Bezel 86 is bolted with bezel bolts 87 to the barrel 31 and captures the shoulder 84 of the jet body 82 beneath bezel flange 88. The bezel 86 tightens the flange 88 against the shoulder 84 when the bolts 87 are tightened completely, to prevent rotation or pivoting. As seen in FIGS. 6 and 7 the inner face of the jet bodies 82 are flush with the barrel bore to maintain its smooth cylindrical surface.

To adjust the angle of the jet axis JA to an axial direction, or in other words, a jet angle of the jet axis JA to a pivot plane PP containing the annulus AA axis and the pivot axis PA of the jet 20, one simply loosens the bezel bolts 87, rotates the jet body 20 about the pivot axis PA to the desired jet angle, and tightens the bolts 87.

Although the angle of the jet axis JA with respect to the pivot axis PA is permanently set at 45 degrees for this preferred embodiment, another angle could just as well be employed. The 45 degree angle, and the structure permitting rotation about the pivot axis PA that is also radial of the annulus, have simply been adopted for convenience, based on estimates of the best orientation of the jet axis JA for adjustment relative to the annulus axis AA.

It should be remembered when selecting the pressures and jet angles that the desired result sought is the jetting of pressurized gas or air in selected nonaxial directions to induce air and particle movement within the annulus to a desired spiral annular flow.

It is preferable to form a spiraling cloud of coating particles that is much longer than the length of the pipe being coated. Stated otherwise, it is desirable to produce a cloud that moves through the length of pipe in a much shorter time than the total time that coating particles are continually fed into the load end of the pipe.

The process for coating an exemplary pipe with the apparatus described above begins by establishing a spiraling air inside the pipe being coated by turning on the compressor and establishing all airflows. The pipe has been preheated to above the fusion temperature of the coating material. As soon as the spiraling airstream clears a discharge end 44 of the pipe 16 opposite the load end 43, or preferably, after a powder injection delay period, the charge gate valve 28 is opened at a variable preselected speed to evacuate the charge of coating particles into the injection tube 29 leading to the annulus 33. Particle flow and establishment of the cloud will be at a controlled rate because of the preselected timed opening of the charge gate valve 28.

As the coating particles enter the annulus they will be deflected and accelerated by the deflector 32 and the spiral airflow to form a turbulent spiraling annular cloud. Spiral flow of the cloud is further induced as the cloud successively moves past the jet bands 37, 38, and 39. Before spiraling into the load end of the pipe, the powder cloud is forced outward toward the pipe 16 walls by the load deflector cone 41.

At the load end, the high tangential or circumferential velocity of the coating particles limits the dwell or residence time during which the particles can be melted by heat from the pipe wall, thus preventing excessive coating thickness at the load end.

As the spiraling cloud travels through the pipe depositing powder particles, constant air pressure is exerted on the cloud. Due to the canceling effects of axial slowing due to friction, and axial acceleration due to lowering cloud density as particles are deposited along the pipe walls, the linear or axial velocity of the particles is essentially unchanged. The spiral form begins to elongate as the tangential velocity of the particles slows due to friction, and the axial or linear velocity of the particles remains constant. As the spiral form elongates toward the end of the pipe the tangential velocity may near zero such that at the end of the pipe, the spiral may more resemble a cylinder with an axial region of lower cloud density.

After the cloud has been extended through the pipe a preset but variable time, the charge gate valve 28 is closed to stop the further injection of coating material into the spiral airflow. After a selected period, all air streams are deactivated, allowing air pressure, and axial flow of coating particles to decline. Any powder still inside the pipe will be evenly deposited on the rotating pipe inside surface as the powder settles. Excess coating particles at the discharge end of the pipe are collected for recycling back to the fluidized bed.

In practice, it is often preferable that the powder injection and airflow periods end at the same time. However, in some cases, more uniform coating is accomplished if the airflow ends after the powder injection has ceased. The determination of the best practice is based on trial and error for the jet angles, pressures and other equipment settings involved.

When not limited by the restrictive example set out above, the process may be broadly stated as follows. Gas is flowed within the annulus toward a load end of the pipe fluidly connected to the annulus. Particles of coating material are suspended to the gas either initially outside the annulus and then injected into the airflow within the annulus or introduced directly into the annulus where the airflow therein suspends the particles. Spiral movement of the particles and gas is induced within the annulus so that an axial component of the spiral movement is directed toward the load end of the pipe and a circumferential component of the spiral movement is directed tangentially of the axis in a direction that is opposite the rotation of the pipe. The spiraling cloud of gas and particles is spiraled into the load end forming a spiral cloud of the gas and particles through the interior of the length of the pipe.

The spiraling means referred to above, and the inducing step just discussed, are not restricted to the particular spiral jet bands and jets selected to induce spiral movement for this particular embodiment. The invention is broad enough in scope to include any means of inducing a spiral cloud form to enter the load end of the tubular goods being coated. Other arrangements of the jets, or even the use of vanes, flights, blades, or other airfoils in the annulus to direct flow into spiral movement, could be used and be within the scope of the invention.

Optionally, the annular spiral cloud may be accelerated and deflected toward the pipe walls as it enters the load end. As described above, the preferred cloud form is far in excess of the length of the tubular goods. The positions of the jet bands 36, 37, 38, and 39, and the position of the powder injection tube may also be referred to as "jetting positions" and "injection positions", respectively.

The jet angle or orientation of the jet axis with respect to the annulus axis, which was also described above as an angle of the jet axis from the pivot axis of the jet and an angle of the jet axis from a pivot plane that includes the annulus axis and the pivot axis of the jet, may also be referred to as a "nonaxial jet direction" with respect to the axis of the annulus. As described above, by the appropriate adjustment of the jets 20, the nonaxial jet direction may be individually selected for each jet. The location of each jet on the barrel 31 may also be referred to as a jet position and the spaced position of each band of jets may also be referred to as a spaced band position along the axis of the annulus.

The following examples, using the indicated diameters of pipe, are provided to apprise the reader of actual results and equipment settings developed from trial and error experimentation. For convenience, the reference number of the particular structure involved at each airflow point is indicated. For example, for the venturi air pressure, the reference number "30" for the location of the venturi tube 30 would be injected.

EXAMPLE NO. 1

A joint of 6⅝-inch, outside diameter pipe, forty feet long, was coated with a coating of the bis-phenol-A epoxy class, using the equipment described in this disclosure. The following settings were used:

| Variable | Ref. No. | Setting | Units |
|---|---|---|---|
| Pipe temperature | 16 | 325 | °F. |
| Pipe rotational speed | 16 | 75 | rpm |
| Powder coating charge | 15 | 20 | lbs |
| Spiral jet band no. 1 | 36 | 25 | psi |
| Spiral jet band no. 2 | 37 | 15 | psi |
| Spiral jet band no. 3 | 38 | 10 | psi |
| Spiral jet band no. 4 | 39 | 5 | psi |
| Spiral jet angles | 20<br>36,37,38,39 | 60 | degrees,<br>forward |
| Hopper injection air | 46 | 30 | psi |
| Venturi air | 30 | 30 | psi |
| Linear air | 35 | 4 | psi |
| Powder injection delay | 28 | 2.0 | sec |
| Powder injection timer | 28 | 10.0 | sec |
| Air stream timers | 50 | 10.0 | sec |

These settings produced a coated joint of pipe with 16 to 18 mils through-out the entire length. No zone of low film thickness was noted. No holidays existed. The pipe was free from runs, sags, blisters, and contamination.

EXAMPLE NO. 2

A joint of 8⅝-inch, outside diameter pipe, forty-two feet long, was coated with epoxidized-cresol-nonvolac type coating, usiing the equipment described in this disclosure. The following settings were used:

| Variable | Ref. No. | Setting | Units |
|---|---|---|---|
| Pipe temperature | 16 | 310 | °F. |
| Pipe rotational speed | 16 | 60 | rpm |
| Powder coating charge | 15 | 23 | lbs |
| Spiral jet band no. 1 | 36 | 25 | psi |
| Spiral jet band no. 2 | 37 | 15 | psi |
| Spiral jet band no. 3 | 38 | 15 | psi |
| Spiral jet band no. 4 | 39 | 8 | psi |
| Spiral jet angles | 20 36,37,38,39 | 60 | degrees, forward |
| Hopper injection air | 46 | 30 | psi |
| Venturi air | 30 | 25 | psi |
| Linear air | 35 | 8 | psi |
| Powder injection delay | 28 | 3.0 | sec |
| Powder injection timer | 28 | 8.0 | sec |
| Air stream timers | 50 | 10.0 | sec |

These settings produced a joint of pipe with 18 to 20 mils (0.018–0.020 inches) through-out the entire length. No low film thickness band was noted. No excess coating build-up was noted on the load end. The coating was "holiday-free".

EXAMPLE NO. 3

A joint of 12¾-inch, outside diameter pipe, forty feet long, was coated with a bis-phenol-A epoxy powder coating. The ends of the pipe had been square cut and a coupling groove had been machined into the ends of the pipe. The following settings were used:

| Variable | Ref. No. | Setting | Units |
|---|---|---|---|
| Pipe temperature | 16 | 325 | °F. |
| Pipe rotational speed | 16 | 50 | rpm |
| Powder coating charge | 15 | 30 | lbs |
| Spiral jet band no. 1 | 36 | 30 | psi |
| Spiral jet band no. 2 | 37 | 25 | psi |
| Spiral jet band no. 3 | 38 | 10 | psi |
| Spiral jet band no. 4 | 39 | 5 | psi |
| Spiral jet angles | 20 36,37,38,39 | 60 | degrees, forward |
| Hopper injection air | 46 | 30 | psi |
| Venturi air | 30 | 30 | psi |
| Linear air | 35 | 12 | psi |
| Powder injection delay | 28 | 3.0 | sec |
| Powder injection timer | 28 | 10.0 | sec |
| Air stream timers | 50 | 10.0 | sec |

These settings produce a coated joint of pipe with a film thickness ranging from 20 to 22 mils, throughout. No holidays were found and there was no indication of a low film thickness zone. The coating was free of runs and sags.

The inventor believes that other structure could be employed to create the desired annular spiral airflow, such as using more or less jets per band, more or less bands spaced more closely or further apart, a longer barrel or annulus and with or without the linear airflow. It is also believed that it is not critical that the coating particle charge be injected downstream of the first spiral jet band, as shown above. The powder cloud could be formed at almost any point, so long as the powder enters the spiral airflow at a point sufficiently upstream from the end of the annulus that the coating particles are directed in a spiral direction at a spiral particle velocity that will form the desired spiral cloud form in the pipe to obtain an even coating without holidays.

The preceding examples utilized the same jet angles for all jets of the bands 36, 37, 38 and 39. The following Example 4, Tables I, II, and III, describe settings used with successively decreased jet angles from band 36 to band 39. Additionally, the opening diameter of the various airflow devices for this example, and the calculations of the cloud length, have been provided. The pipe being coated has an 8⅝ inch outside diameter and is 40 feet long.

EXAMPLE NO. 4

TABLE I

Pressure settings, spiral jet angles for each band, weight of powder injected, and process timing is set forth below.

| Variable | No. | Setting | Units |
|---|---|---|---|
| Spiral jet band no. 1 | 36 | 14.5 | psi |
| Spiral jet band no. 2 | 37 | 11.5 | psi |
| Spiral jet band no. 3 | 38 | 11.5 | psi |
| Spiral jet band no. 4 | 39 | 16.0 | psi |
| Spiral jets, band no. 1 | 20–36 | 60 | deg |
| Spiral jets, band no. 2 | 20–37 | 45 | deg |
| Spiral jets, band no. 3 | 20–38 | 30 | deg |
| Spiral jets, band no. 4 | 20–39 | 15 | deg |
| Powder coating charge | 15 | 23 | lbs |
| Hopper injection air | 46 | 16 | psi |
| Venturi air | 30 | 16 | psi |
| Linear air | 35 | 16 | psi |
| Powder injection delay | 28 | 1.5 | sec |
| Powder injection timer | 28 | 4.0 | sec |
| Air stream timers | 50 | 10.0 | sec |
| Charge gate valve open | 15 | max | |

TABLE II

The airflow device opening sizes and the percent each devices contributes to the total airflow rate at the pressure stated in Example No. 4 - Table I are stated below.

| Variable | No. | Setting | Units |
|---|---|---|---|
| Linear tube opening | 35 | 2.5 | diam, in. |
| Venturi tube opening | 30 | 0.5 | diam, in. |
| Hopper injection inlets | 46 | 3 × 0.5 | diam, in. |
| Spiral jets, band no. 1 | 20–36 | 3 × 0.375 | diam, in. |
| Spiral jets, band no. 2 | 20–37 | 3 × 0.375 | diam, in. |
| Spiral jets, band no. 3 | 20–38 | 3 × 0.375 | diam, in. |
| Spiral jets, band no. 4 | 20–39 | 3 × 0.375 | diam, in. |
| Linear tube | 35 | 68.05 | % tot. |
| Venturi tube | 30 | 3.32 | % tot. |
| Hopper injection inlets | 46 | 4.68 | % tot. |
| Spiral band no. 1 | 20–36 | 6.26 | % tot. |
| Spiral band no. 2 | 20–37 | 5.56 | % tot. |
| Spiral band no. 3 | 20–38 | 5.56 | % tot. |
| Spiral band no. 4 | 20–39 | 6.57 | % tot. |
| TOTAL airflow | 43 | 470.67 | cu. ft. |

TABLE III

The data regarding the length of the powder cloud in feet and elapsed time is shown below.

| | |
|---|---|
| Experimental Time for Cloud to clear 40 foot pipe | |
| Elapsed time to first exit, sec. | 3.19 |
| Delay between start and powder injection | − 1.50 |
| Powder cloud travel time, sec. | 1.69 |
| Experimental Velocity of Powder Cloud | |
| 40 feet/1.69 sec = 23.67 ft/sec at leading edge | |
| Experimental Length of Powder Cloud, Time | |
| Total time from start until cloud ends (sec) | 10.53 |
| Delay from start to powder injection (sec) | − 1.50 |
| Total length of powder cloud (sec) | 9.03 |
| Experimental Length of Powder Cloud | |
| Experimental velocity (ft/sec) | 23.67 |

TABLE III-continued

| The data regarding the length of the powder cloud in feet and elapsed time is shown below. | |
|---|---|
| Time length of cloud (sec) | × 9.03 |
| Length of powder cloud (feet) | 213.74 |

Figure 8:
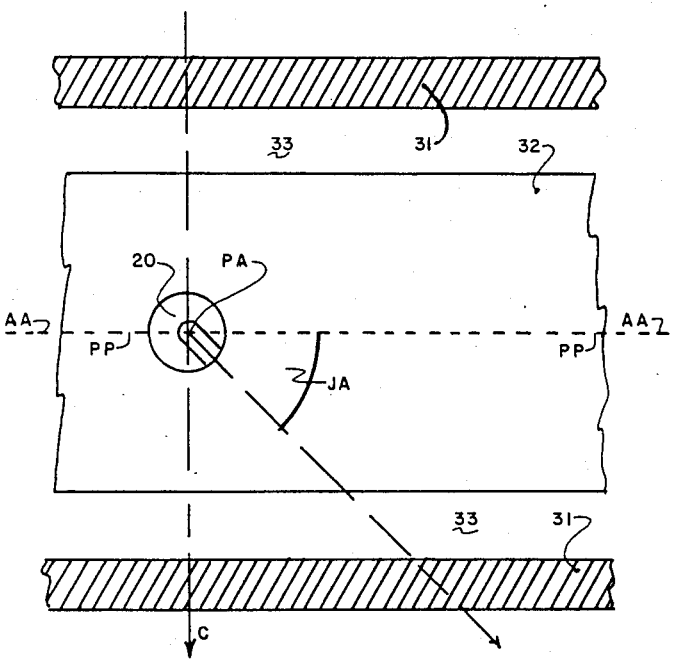
FIG. 8 is a side schematic of a spiral jet showing the component directions of the spiral and jet airflows.
Figure 9:
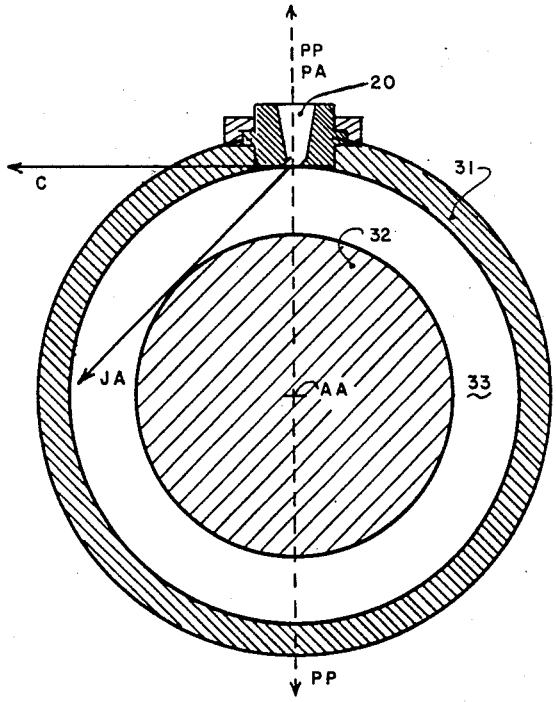
FIG. 9 is an end schematic view of FIG. 8.
Figure 10:
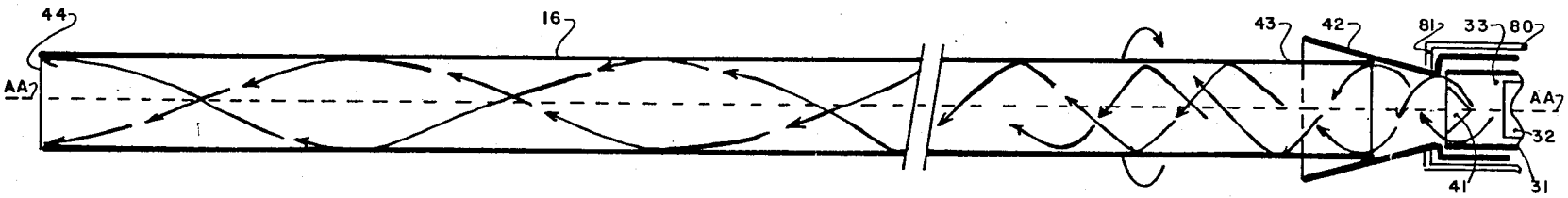
FIG. 10 is a side section view of the pipe connected to the apparatus shown in FIG. 5 with spiral flow indicated by arrows.

As shown in FIGS. 5 and 10, the jet bands 36, 37, 38 and 39 successively deflect the cloud of coating particles to the desired spiral annular flow. A brief description of the effect of each air input to the annulus on the circumferential component of the spiral movement, as defined above, and based on the settings of Example 4, follows. The angles are measured from a pivot plane PP (FIGS. 8 and 9) that includes the longitudinal annulus axis AA and the pivot axis PA of the jets 20. The pivot axis PA of each jet 20 is radial of the annulus axis AA. The circumferential component that has a tangential direction is shown as C in FIGS. 8 and 9. A jet axis JA extends in the direction of air flow into the annulus from the jet 20. When considering the description of the deflections of the airflows decribed hereafter, it may be helpful to refer back to FIGS. 8 and 9 as a reference to the angles of the axes and planes described.

The arrows in FIG. 5 describe the successive deflections resulting from the jetting of air in selected nonlinear directions to induce the spiral flow within the annulus. Although for the sake of clarity the angles of deflection have been exaggerated in FIG. 5, the flow arrows do indicate the successive further inducing of spiral flow as the particles of coating material and air move past the jet bands 36, 37, 38 and 39.

The airflow from the linear injection tube 35 enters the annulus 33 in substantially longitudinal or axial direction and hence has zero degrees of deflection from the pivot plane. The jet axes JA of the jets 20 of the first spiral band 36 is set at 60 degrees from the respective pivot planes PP. At the pressure and volumetric flow rate involved, where slightly more than 8 percent of the airflow is at 60 degrees and slightly less than 92 percent of the airflow is linear or at zero degrees, the resulting deflection to spiral flow is at an angle of 4.2 degrees from the pivot planes of the jets 20.

The combined hopper and venturi streams injected from the powder injection tube 29 will enter at an angle of about 60 degrees and represent about 10 percent of the combined airflows downstream of the powder injection tube 29. The resultant spiral deflection is increased to about 9.4 degrees from the pivot plane PP.

Downstream of the powder injection tube 29, the jets 20 of the spiral jet band 37 are set at angles of 45 degrees to their respective pivot planes PP. The airflow from the band 37 represents about 6 percent of the total combined flow rates downstream of the jet band 37. The angle of the resulting spiral flow from the pivot planes will be increased by a 3 degree net contribution from the spiral jet band 37, resulting in a 12.4 spiral angle from the pivot plane.

The jet angles of the jets 20 of the successive jet bands 38 and 39 at 30 degrees and 15 degrees, respectively, from their respective pivot planes PP result in a net addition to the spiral deflection of 1.7 and 1.9 degrees, for a total spiral deflection of about 16.6 degrees from the pivot plane, or axial flow.

Figure 12:
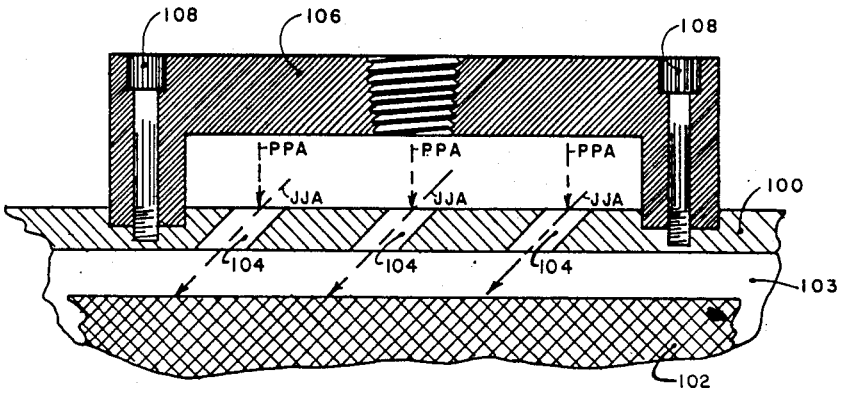
FIG. 12 is a side section view of the jet band shown in FIG. 11.
Figure 11:
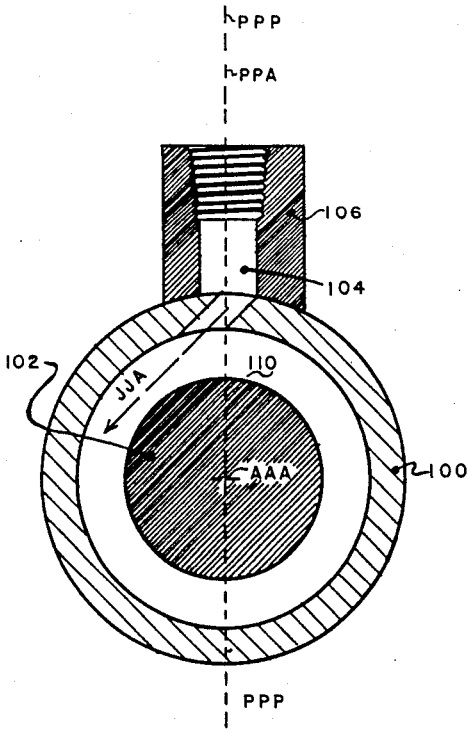
FIG. 11 is an end section of an alternate jet band embodiment and jet disposition for smaller pipe and annulus.

Referring to FIGS. 11 and 12, another embodiment of a jet band for use on a coating barrel of small inside diameter for coating small pipe is shown. Such a coating apparatus would preferably be substantially the same as the apparatus described above for coating large diameter pipe, except that the small circumference of the smaller barrel makes the jet band structure of the bands 36, 37, 38 and 39 infeasible.

Coating barrel 100 is substantially identical to the barrel 31, except the bore is smaller. The barrel 100 has annulus axis AAA extending longitudinally of the barrel 100 bore. Deflector 102 is coaxially disposed within the bore of the barrel 100. For convenience, the jet bores along jet axes JJA of jets 104 are permanently set at 45 degrees from a radial pivot axis PPA of each jet 104, and from a pivot plane PPP that includes the pivot axis PPA and the annulus axis AAA.

Jet band block 106 is bolted to the barrel 100 by block bolts 108. The block 106 is constructed so that it will fit flush with the barrel around the jets 104 and enclose the jets 104 with an airtight seal. As may be seen the pivot axis PPA is an annular radius that intersects the jet axis JJA.

Another difference of the apparatus for coating the inside surface of small diameter tubular goods is that the defelctor cone 41 need not be employed. The applicability of the invention to a wide range of pipe diameters demonstrates the basic, fundamental character of the invention as a revolution of the pipe coating art.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention upon expiration of this patent. The limits of the invention and the bounds of the patent protection are measured by and defined in the following claims.

I claim as my invention:

1. A process for coating an interior surface of tubular goods, comprising the steps of:

a. flowing gas within an elongated annulus having a longitudinal axis and having smooth cylindrical surfaces toward a load end of a length of the tubular goods fluidly connected to one end of the annulus, b. suspending uncharged particles of solid powder coating material in the gas, c. jetting gas into the annulus at a plurality of axially spaced jets spaced along the annulus, the jets having a nonaxial jet direction, thereby inducing spiral movement of the gas and particles of coating material within the annulus, so that the spiral movement has an axial component directed toward the load end and a circumferential component directed tangentially of the axis, d. spiraling the gas and particles of coating material into the load end of tubular goods, dd. forming a spiral cloud of the gas and particles of coating material through the interior of the length of tubular goods, and e. rotating the length of tubular goods about a pipe axis that is parallel to the axis of the annulus, in a direction that is counter to the circumferential component of the spiral movement of the gas and particles of coating material and causing the coating material to deposit on the interior surface of said tubular goods, said tubular goods having been heated above the fusion temperature of the coating material.

2. The invention as defined in claim 1 including all of the limitations a. through e. with the addition of the following limitation:

f. performing the jetting step at a plurality of circumferentially spaced jet positions at an axial position along the annulus.

3. The invention as defined in claim 1 including all of the limitations a. through e. with the addition of the following limitation:

f. deflecting the spiral flow away from the axis and toward the inside surface of the tubular goods at the load end.

4. The invention as defined in claim 1 including all of the limitations a. through e. with the addition of the following limitation:

f. maintaining the rate of gas flow into the tubular goods constant during the above steps.

5. The invention as defined in claim 1 including all of the limitations a. through e. with the addition of the following limitation:

f. performing the spiraling step "d." above for a substantially greater particle injection period than a time period required for a particle of the coating material to move completely through the length of tubular goods.

6. The invention as defined in claim 1 including all of the limitations a. through e. with the addition of the following limitations:

f. the suspending step above being performed by
g. dumping a premeasured charge of coating material into an injection tube fluidly connected to the annulus, while
h. injecting gas into the injection tube downstream of the charge of coating material between the charge and the annulus, and
i. flowing the injected gas toward the annulus, thereby
j. suctioning particles from the charge of coating material into the injection tube,
k. suspending the particles in the injection gas flowing toward the annulus, and
l. flowing the injection gas and the particles suspended therein into the annulus from the injection tube.

7. The invention as defined in claim 1 including all of the limitations a. through e. with the addition of the following limitations:

f. the suspending step above being performed by
g. dumping a premeasured charge of coating material into a flow of gas,
h. suspending the particles in the flow of gas, and
i. injecting the flow of gas and suspended particles into the flow of gas within the annulus at an injection position axially upstream along the annulus from the load end.

8. The invention as defined in claim 7 including all of the limitations a. through i. with the addition of the following limitations:

j. initiating the inducing step above at an axially upstream position that is more distal of the load end than the injecting position,
k. further inducing the spiral movement at an axially downstream position that is more proximate the load end than the injection position.

9. The invention as defined in claim 1 including all of the limitations a. through e. with the addition of the following limitation:

f. performing the jetting step at a plurality of circumferentially spaced jet positions at each of a plurality of axially spaced band positions along the axis of the annulus.

10. Apparatus for coating an interior surface of tubular goods, comprising:

a. an elongated barrel having a longitudinal axis and a smoothy cylindrical axial bore with an open end,
b. an elongated smooth cylindrical deflector coaxially disposed within the bore to form an elongated annulus with smooth cylindrical walls extending a length of the deflector coaxially with the axial bore,
c. connector means at the open end of the bore for fluidly connecting an end of the annulus to a load end of a length of the tubular goods,
d. a source of compressed gas,
e. gas means for flowing gas from the source of compressed gas into the annulus toward the open end of the bore,
f. injection means fluidly connecting a source of coating material to the annulus for suspending particles of the coating material in the gas within the annulus,
g. a plurality of jets fluidly connected to the source of pressurized gas and mounted on the barrel along the axis thereof for the discharge of pressurized gas directly into the annulus,
h. each of the jets oriented at selected axial and tangential angles so that at selected airflow rates through the jets spiral movement of the gas and particles of coating material is induced within the annulus, with the spiral movement having an axial component directed toward the outlet end and a circumferential component directed tangentially of the axis, and
i. rotation means for rotating the length of tubular goods connected thereto in a direction opposite to the spiraling motion of the gas and particles.

11. Apparatus for coating an inside diameter of tubular goods, comprising:

a. an elongated barrel having a longitudinal axis and a smooth cylindrical axial bore,
b. an elongated smooth cylindrical deflector coaxially disposed within the barrel bore to form an elongated annulus with smooth cylindrical walls extending a length of the deflector,
c. a source of pressurized gas,
d. a linear injector fluidly connecting the source of pressurized gas to an inlet end of the barrel for axial flow of pressurized gas into the annulus,
e. a rotatable coupling at an outlet end of the barrel providing for fluid connection of a load end of a length of the tubular goods to the bore,
ee. rotation means connected to the rotatable coupling for rotating the coupler and thus the length of tubular goods,
f. a source of coating material,
g. a hopper fluidly connected to the annulus by an injection tube,
h. measuring means associated with the hopper for measuring a desired charge of coating material into the hopper,
i. a valve on the hopper for selectably releasing the charge of coating material into the injection tube, j. injection means fluidly connecting the source of pressurized gas to the injection tube for suspending particles of coating material released into the injection tube in a flow of gas within the injection tube, k. a plurality of jets fluidly connected to the source of pressurized gas and mounted on the barrel along the axis thereof for the discharge of pressurized gas directly into the annulus, l. each of the jets oriented at selected axial and tangential angles so that at selected airflow rates through the jets spiral movement of the gas and particles of coating material is induced within the annulus, with the spiral movement having an axial component directed toward the outlet end and a circumferential component directed tangentially of the axis, and in a direction opposite that of the tubular goods rotation.

12. The invention as defined in claim 11 including all of the limitations a. through l. with the addition of the following limitation:

m. pressure control means in the fluid connection of each jet to the source of pressurized gas for maintaining a selected pressure of gas flowed to each jet so that the selected flow rates of gas through each jet is maintained.

13. The invention as defined in claim 11 including all of the limitations a. through l. with the addition of the following limitation:

m. a deflector cone oriented at the outlet end to deflect airflow from the barrel toward the inside diameter of the tubular goods.

14. The invention as defined in claim 11 including all of the limitations a. through l. with the addition of the following limitations;

m. the jets disposed in a plurality of bands, n. pressure control means in the fluid connection of the jets of each band to the source of pressurized gas for maintaining a selected pressure of gas flowed to the jets of each band so that the selected flow rates of gas through each jet is maintained.

15. The invention as defined in claim 14 including all of the limitations a. through n. with the addition of the following limitations:

o. the jets of each band axially grouped, and p. the spiral jets of each band being oriented at substantially identical selected angles to the axis of the annulus and to a plane that is normal to the axis of the annulus.

* * * * *